US012305334B2

(12) United States Patent
Yasui et al.

(10) Patent No.: US 12,305,334 B2
(45) Date of Patent: May 20, 2025

(54) TISSUE PAPER

(71) Applicant: Daio Paper Corporation, Ehime (JP)

(72) Inventors: Shuta Yasui, Shizuoka (JP); Minoru Iwasaki, Shizuoka (JP)

(73) Assignee: Daio Paper Corporation, Ehime (JP)

( * ) Notice: Subject to any disclaimer, the term of this patent is extended or adjusted under 35 U.S.C. 154(b) by 496 days.

(21) Appl. No.: 17/763,326

(22) PCT Filed: Sep. 29, 2020

(86) PCT No.: PCT/JP2020/036917
§ 371 (c)(1),
(2) Date: Mar. 24, 2022

(87) PCT Pub. No.: WO2021/065911
PCT Pub. Date: Apr. 8, 2021

(65) Prior Publication Data

US 2022/0372710 A1 Nov. 24, 2022

(30) Foreign Application Priority Data

Oct. 1, 2019 (JP) ..... 2019-181556

(51) Int. Cl.
*D21H 27/00* (2006.01)
*D21H 23/56* (2006.01)
*D21H 27/30* (2006.01)

(52) U.S. Cl.
CPC ..... *D21H 27/002* (2013.01); *D21H 23/56* (2013.01); *D21H 27/30* (2013.01)

(58) Field of Classification Search
CPC ..... D21H 27/002; D21H 23/56; D21H 27/30
See application file for complete search history.

(56) References Cited

U.S. PATENT DOCUMENTS

| | | | | |
|---|---|---|---|---|
| 2008/0044616 | A1* | 2/2008 | Hanao | A61L 15/60 428/68 |
| 2016/0145808 | A1* | 5/2016 | Weaver | D21H 25/005 162/100 |
| 2017/0121911 | A1* | 5/2017 | Anand | D21H 19/14 |
| 2018/0213981 | A1* | 8/2018 | Vogt | A47K 10/16 |
| 2021/0040695 | A1 | 2/2021 | Yoshida | |

FOREIGN PATENT DOCUMENTS

| | | | | |
|---|---|---|---|---|
| JP | 2011-152402 | A | 8/2011 | |
| JP | 2012-170656 | A | 9/2012 | |
| JP | 2013-188291 | A | 9/2013 | |
| JP | 2018-171254 | A | 11/2018 | |
| JP | 2019-150136 | A | 9/2019 | |
| WO | WO-0112902 | A1 * | 2/2001 | B32B 29/00 |

* cited by examiner

*Primary Examiner* — Jacob T Minskey
*Assistant Examiner* — Stephen M Russell
(74) *Attorney, Agent, or Firm* — Renner, Kenner; Arthur M. Reginelli

(57) ABSTRACT

Provided is 3-ply tissue paper suitable for performing "tissue off" and excellent in softness and smoothness.
In the 3-ply tissue paper containing an aqueous moisturizer, a paper thickness for three plies is 176 to 230 μm, an arithmetic mean roughness Sa is 0.007 to 0.020 mm, and a compression work is 1.70 to 2.40 gf·cm/cm$^2$ and a compression recovery rate is 46.0 to 54.5% for four sets of three plies, twelve plies in total.

6 Claims, 5 Drawing Sheets

The arithmetic mean roughness (Sa) defined on the basis of ISO 25178 is obtained The measurement of the flat surface roughness in the visual field area (24 mm × 18 mm)
The square area (3.000 mm x 3.000 mm) shown below
Note: The portion for the measurement of the flat surface roughness is located at the center with minimized distortion in the visual field

TISSUE PAPER

TECHNICAL FIELD

The present invention relates to tissue paper, and more particularly to tissue paper containing a moisturizer.

BACKGROUND ART

As tissue paper, 2-ply tissue paper is widely used, but in recent years, the demand for multi-ply tissue paper such as 3-ply or 4-ply tissue paper having thickness texture is increasing.

Such multi-ply tissue paper is often considered to be a high-grade product belonging to a high price product group. In particular, "fluffy and bulky texture", "surface smoothness" and "softness" are highly required.

Then, in the case of a multi-ply structure, when a basis weight per each ply is increased, the paper thickness can be easily increased due to the combination of individual plies so that the thickness texture and bulkiness can be exhibited.

However, by increasing the basis weight per each ply in this way, it becomes difficult to obtain quality with softness and smoothness.

Various types of tissue paper are commercially available and among them, there is so-called moisturized tissue or lotion tissue which contains an aqueous moisturizer.

Conventional moisturized tissue or lotion tissue is designed to have quality with softness and smoothness and is targeted at people who frequently blow the nose due to hay fever or a cold such that the skin does not reddish or sore even after repeated use.

The moisturized tissue or lotion tissue is partly used also for cosmetic application because damage it causes to the skin is less than non-moisturized tissue having no moisturizer. Specifically, the moisturized tissue or lotion tissue is used for: wiping off lipstick, so-called performing "tissue off" of lipstick, after the lipstick has been put on the lips; for wiping off excess lipstick which has been applied out of the lips; for performing the "tissue off" of makeup foundation when the foundation is floated and broken on the face in a dry environment (to cause flaky skin); or the like.

Usage patterns of respective countries are more than slightly different each other, which seems to be made on the basis of different ways of living and different cultural styles.

As a moisturized tissue or lotion tissue, 2-ply tissue is mainly used in Japan, while 3-ply tissue is mainly used in China.

The conventional lotion tissue designed with importance put on skin touch is poor in paper strength (soft) and thus apt to break, so that the lotion tissue is not suitable to perform the "tissue off" of oil-based lipstick applied on the soft lips or of floated foundation (powders or powders contained in a viscous liquid) applied on the cheeks.

CITATION LIST

Patent Literature

Patent Literature 1: JP 2018-171254 A

SUMMARY OF INVENTION

Technical Problem

Therefore, an object of the present invention is to provide 3-ply tissue paper suitable for performing "tissue off" and excellent in softness and smoothness, and a method for manufacturing the same.

Solution to Problem

In the present invention, tissue paper for solving the above problem includes 3-ply tissue paper, and an aqueous moisturizer contained in the 3-ply tissue paper wherein the tissue paper has a paper thickness for three plies of 176 to 230 μm, an arithmetic mean roughness Sa of 0.007 to 0.020 mm, a compression work of 1.70 to 2.40 gf cm/cm$^2$ and a compression recovery rate of 46.0 to 54.5% for four sets of three plies, twelve plies in total.

Further, in the present invention, a method for manufacturing the tissue paper according to claim 1 includes:

Calendaring a 3-ply base paper through between two metal rolls in a state where three sheets of 1-ply base paper are stacked; and applying a chemical solution to the 3-ply base paper.

In the present invention, another method for manufacturing the tissue paper according to claim 1 includes picking up a chemical solution with a gravure roll;

transferring the picked-up chemical solution to a metal roll; and applying the transferred chemical solution to a surface of 3-ply base paper formed of three stacked sheets of 1-ply base paper while passing through between the metal roll and another metal roll opposing each other.

In the present invention, further another method for manufacturing the tissue paper according to claim 1 includes picking up a chemical solution with a gravure roll;

transferring the picked-up chemical solution to a metal roll;

applying the transferred chemical solution to a first outer surface of 3-ply base paper formed of three stacked sheets of 1-ply base paper while passing through between the metal roll and another metal roll opposing each other;

at a subsequent position, picking up a chemical solution with a gravure roll;

transferring the picked-up chemical solution to a metal roll; and applying the transferred chemical solution to a second outer surface of the 3-ply base paper while passing through the metal roll and another metal roll facing each other.

Advantageous Effects of Invention

According to the present invention, there is provided 3-ply tissue paper suitable for "tissue off" and excellent in softness and smoothness.

DESCRIPTION OF EMBODIMENTS

Figure 1:
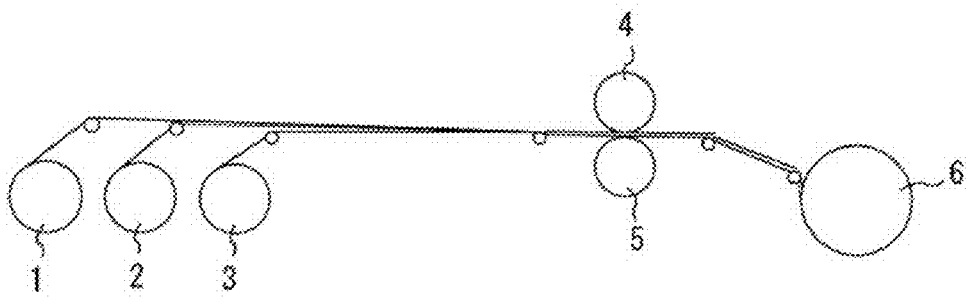
FIG. 1 is a schematic diagram illustrating a stacking mode.

Hereinafter, an embodiment of the present invention will be described.

The tissue paper according to the embodiment is 3-ply tissue paper and contains an aqueous moisturizer.

It is noted that 2-ply tissue paper does not have a sufficient strength.

A paper thickness for three plies is preferably 176 to 230 μm, in particular, more preferably 180 to 220 μm.

An arithmetic mean roughness Sa of a surface measured with a one-shot 3D measurement is preferably 0.007 to 0.020 mm, in particular, more preferably 0.010 to 0.018 mm.

For four sets of three plies, twelve plies in total, a compression work is preferably 1.70 to 2.40 gf·cm/cm$^2$, in particular, more preferably 1.75 to 2.20 gf·cm/cm$^2$.

In addition, a compression recovery rate is preferably 46.0 to 54.5%, in particular, more preferably 48.0 to 54.0%.

It is possible to obtain lotion tissue being suitable to perform tissue off of oil-based lipstick applied on the soft lips or floated foundation applied on the cheeks.

Lipstick contains, as a component, a pigment made from a natural coloring matter such as safflower and cochineal, or a coloring matter being a synthetic coloring agent such as a mainly tar-based coloring matter. An oil such as wax into which this component has been dissolved is poured into a mold to be solidified for making the lipstick.

Besides these components, the lipstick as a product contains many other components such as surfactants, antioxidants, and fragrances. The lipstick adhered to tableware, clothes, etc., becomes a stain and it is very difficult to remove such a stain due to the oil and the pigment as main components of the lipstick, and in addition, due to recently often-used components making the color of lipstick long lasting. Thus, there are also many products that appeal the property of being less likely to adhere to tableware or the like.

Foundation is generally made from an oil-based material which is similar to cream and emulsion and to which a pigment is added for so-called "complementing the skin tone." The foundation may also contain a component for blocking out UV rays and a component for preventing dry skin.

There are mainly two methods for using the foundation: (a) makeup base cream is applied to the face and after that, powder foundation is used so as to be applied on the makeup base cream; and (b) makeup base cream which contains already powder foundation is used singularly.

Foundation can be broken into the following types.

(1) Cake type: This foundation is made by coating the surfaces of pigment particles with an oil-based component such as silicone or a surfactant, and the coated pigment particles are compressed to be solidified. This foundation is applied to the skin with a sponge. This foundation is also referred as powder foundation.

(2-1) Water-using type: This foundation is emulsified when taken on a wet sponge. Then, after the application of the foundation, the water which has been contained in the applied foundation dries such that a coating film remains on the skin after the drying. The feeling of use of applied this foundation is close to that of liquid type foundation (described later).

(2-2) Water-free type: This foundation is applied with a dry sponge. The foundation itself contains a slightly small amount of oil-based component and can be applied lightly.

(3) 2WAY type: For applying this foundation, either a wet sponge or a dry sponge can be used. Therefore, either the characteristics of the wet sponge or those of the dry sponge can be utilized according to the season or the user's preference.

(4) Powder type: This foundation is in the form of powders. This foundation is applied to the skin with a brush or a puff. After makeup base cream is applied to the skin for giving an oil content thereto, the foundation is applied on the makeup base cream. However in some products of this foundation, without using such makeup base cream, the foundation can be adhered to the skin due to the sebum of the skin itself.

(5) Mineral foundation: This foundation is powder foundation containing mica, titanium oxide, iron oxide, zinc oxide, etc. as the main components. Many products of this foundation feature that the foundation is made from only natural minerals without oil or additives. This foundation was spreading in the United States in 1970s.

(6) Cream type: This foundation contains an oil-based component in the form of cream and is also referred as cream foundation. This foundation is applied with a sponge, and besides, in some products of this foundation, the foundation can be applied directly with the user's fingers or with a spatula.

(7) Liquid type: This foundation contains an oil-based component in the form of liquid and is also referred as liquid foundation. This foundation is applied with a sponge, and in addition, this foundation can be applied directly with the user's fingers. Further lately, in some products of this foundation, the foundation is sprayed onto the skin as spray foundation. In this foundation, since larger amounts of oil-based components surround pigment particles, the foundation exhibits higher spreadability and higher covering effect for the skin tone than the cake type foundation does. Further, it has a high resistance to water and oil. However a user tends to wear too much liquid type foundation, which may cause the skin trouble. In recent years, in some products of this foundation, the foundation has a reduced amount of oil-based component, using an aqueous base material.

With respect to the wiping off of cosmetic materials, in order to wipe off an oil-based cosmetic material applied to the particularly soft lips or soft skin of cheeks so as not to damage the skin, the tissue paper in the above embodiment has a paper surface with a less unevenness (small surface roughness Sa) and has a smooth surface texture due to a moisturizing lotion agent.

Lipstick or foundation has mainly an oil-based component, and the above-mentioned 3-ply moisturized tissue has a paper quality with softness in the thickness direction and a reduced compression recovery rate. This makes it easy to control the strength for wiping off the lipstick or foundation. Further, since the moisturizing lotion agent has a suitable solubility with the oil-based lipstick or foundation, the 3-ply moisturized tissue has a suitable wiping property, namely, it is not difficult to wipe off the cosmetic, but this does not mean that the cosmetic is wiped off too much.

The values of "arithmetic mean roughness Sa," "compression work" and "compression recovery rate" of the surface measured with the one-shot 3D measurement according to the present invention are suitable for performing the "tissue-off." The reason for this is considered as follows.

A small value of the "arithmetic mean roughness Sa" indicates a smooth surface.

A large value of the "compression work" indicates that a compression stage starts quickly and lasts long, resulting in a favorably soft surface.

A small value of the "compression recovery rate" means that once a surface is pushed, the surface hardly returns to an original state, which improves the controllability of pressure and contributes to making it easier to control the strength for wiping off the lipstick or foundation.

The tissue paper according to the present invention has an arithmetic mean roughness (Sa) of an outer surface in an unpressurized state of 0.007 to 0.020 mm, particularly 0.010 to 0.018 (mm). A measurement performed in an unpressurized state means that the measurement performed in an unprocessed ("ecru") state.

The arithmetic mean roughness (Sa) is defined on the basis of ISO 25178 and refers to the arithmetic mean value of the absolute values of heights of respective points based on a mean plane within a definition area. It is indicated that the smaller the value is, the smaller the absolute value of the height of each point of the surface on the basis of the mean plane is, namely the flatter shape the surface has. On the other hand, it is indicated that the larger the value is, the rougher shape the surface has.

In a sample obtained from a pop-up-type bundle of tissue paper, noted that the measurement surface is a surface corresponding to the mountain side of the fold (the same applies to an arithmetic mean peak curvature Spc.) Since the arithmetic mean roughness (Sa) of the outer surface in the unpressurized state is 0.007 to 0.020 mm, particularly 0.010 to 0.018 mm, the surface is smooth and excellent in wiping property.

It is preferable in the present invention that the arithmetic mean peak curvature (Spc) of the outer surface in the unpressurized state of the tissue paper is 3.4 to 3.9 (1/mm). The arithmetic mean peak curvature refers to the arithmetic mean value of the principal curvature of peaks in the definition area. It is indicated that the smaller the value is, the more rounded shapes the points of contact with other objects have. On the other hand, it is indicated that the larger the value is, the more pointed shapes the points of contact with other objects have.

In a sample obtained from a pop-up-type bundle of tissue paper, noted that the measurement surface is a surface corresponding to the mountain side of the fold. When the arithmetic mean peak curvature (Spc) of the outer surface in the unpressurized state is 3.4 to 3.9 (1/mm), the surface is excellent in the wiping property for lipstick and foundation while being felt smooth.

The "arithmetic mean roughness (Sa)" and "arithmetic mean peak curvature (Spc)" according to the present invention are values obtained by performing a measurement by use of "Wide-Area 3D Measurement System VR-3200 (One-shot 3D shape measurement system VR-3200) (manufactured by KEYENCE CORPORATION) (hereinafter also referred to as "3D Microscope") or an instrument equivalent thereto (non-contact three-dimensional measuring instrument).

The "3D microscope" is capable of measuring the shape of an object from a projected patterned image thereof taken by the monochromic C-MOS camera by structured illumination emitted from a transmitter, and in particular, capable of measuring the height, length, angle, volume or the like of any portion by use of the projected patterned image taken as described above. Software "VR-H2A" or a software equivalent thereto can be used for observing, measuring and analyzing images obtained by the "3D microscope". Noted that the measurement conditions are a visual field area of 24 mm×18 mm and a magnification of 12 times.

The specific measurement procedures for the "arithmetic mean roughness (Sa)" and "arithmetic mean peak curvature (Spc)" of an outer surface in an unpressurized state are as follows.

Tissue paper in the form of multi-ply as a sample (with a size of about 50 mm in the MD (machine direction) and 50 mm in the CD (cross direction)), is placed on a measurement table as it is in an unprocessed state in such a manner that the length direction coincides with the MD with the measuring machine placed on the front. Noted that the sample used for measurement is a flat portion of a product.

Figure 4:
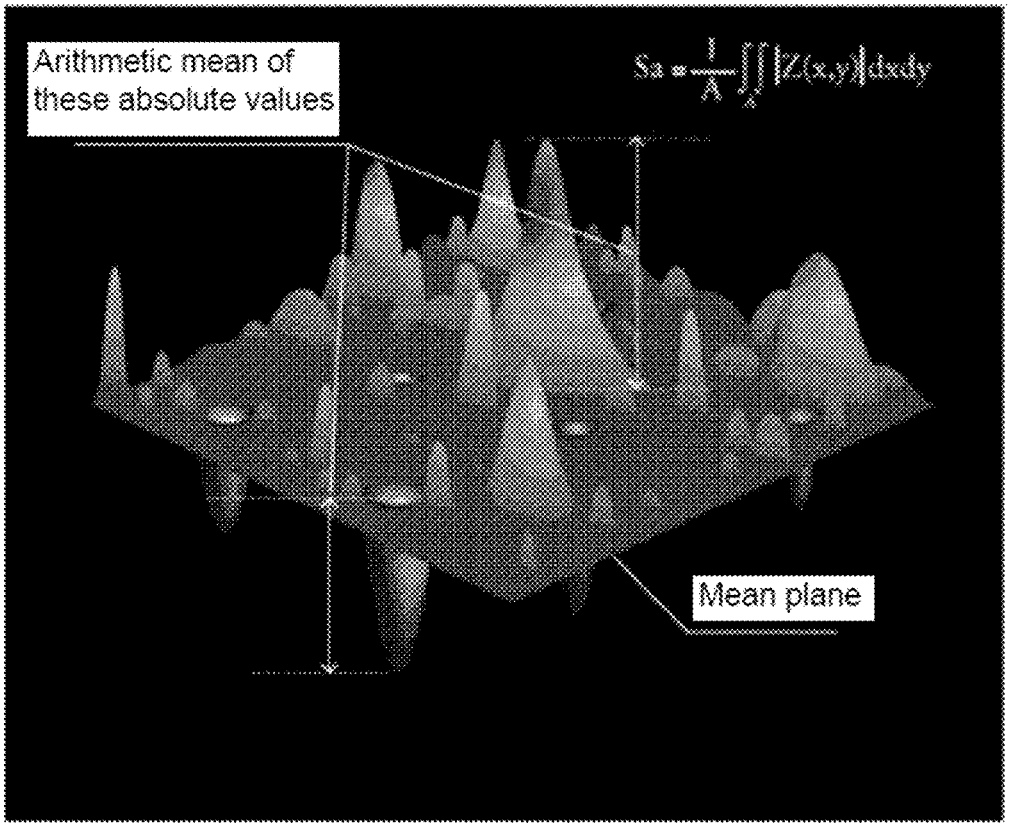
FIG. 4 is an explanatory drawing of an arithmetic mean roughness Sa.

By following the on-screen guide of the software ("VR-H2A"), three images of a sample surface are obtained which are a main image (texture), a main image (height) and a 3D image. Next, a "texture" image, which is displayed by selecting "Surface Roughness" and the like with the above software, is converted to a "height" image (image represented by the contrasting density of color tones color-coded in the height direction) as shown in FIG. 4. Noted that in FIG. 4, the "height" image is represented by grayscale, but the actually obtained "height" image is an image represented by the contrasting density of color tones color-coded in the height direction.

Next, at least the maximum height (Sz), the arithmetic mean roughness (Sa), and the arithmetic mean peak curvature (Spc) are set as measurement parameters, followed by performing measurement. The measurement range has a size of 3.000 mm×3.000 mm. The software enables the measurement range to be set by selecting "specify value" in "add area". The measurement range should be set so as not to include embossed portions and so as to have a substantially constant contrasting density of color tones in respective measurement ranges on the screen visually.

The values of the measured maximum height (Sz), arithmetic mean roughness (Sa), and arithmetic mean peak curvature (Spc) are checked, if the maximum height (Sz) exceeds 0.1000 mm, it is necessary to cancel them and to reset another measurement range. Noted that the maximum height (Sz), arithmetic mean roughness (Sa), and arithmetic mean peak curvature (Spc) are parameters of a surface roughness defined on the basis of ISO 25178. In addition, for the measurement, both of filter treatment and preliminary treatment are not performed.

Figure 5:
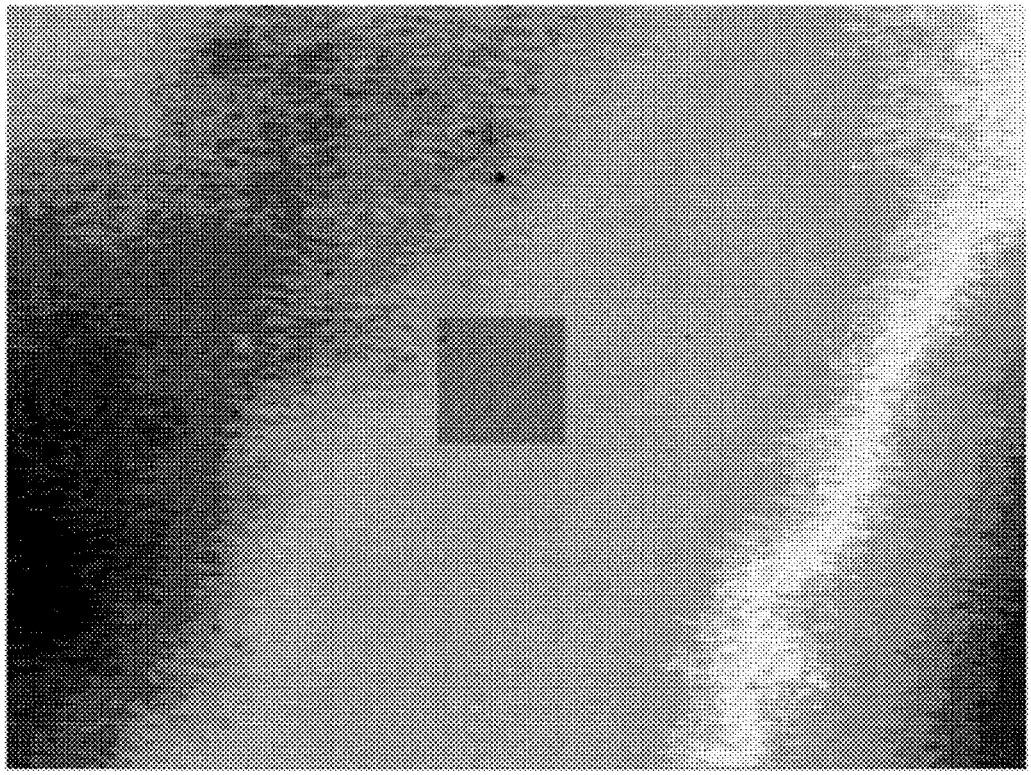
FIG. 5 shows a measurement range of a surface roughness.

In a measurement range having the size of 3.000 mm×3.000 mm, (for example, an area surrounded by a square in FIG. 5), as the measurement of the flat surface roughness, the "maximum height (Sz)," "arithmetic mean roughness (Sa)" and "arithmetic mean peak curvature (Spc)" are measured. In the measurement range having the size of 3.000 mm×3.000 mm, the flat surface roughness is measured at different measurement locations in a total of five times, and the average of the five measurement values is taken as the measurement value of each of the "maximum height (Sz)," "arithmetic mean roughness (Sa)" and "arithmetic mean peak curvature (Spc)" for the measured sample. In the measurement range having the size of 3.000 mm×3.000 mm, measurement is performed at a center portion with minimized distortion in a visual field area of 24 mm×18 mm. The above five measurement portions are selected respectively and the "maximum height (Sz)," "arithmetic mean roughness (Sa)," and "arithmetic mean peak curvature (Spc)" may be measured at the same time, or the range Z in which the measurement is performed may be changed.

The tissue paper according to this embodiment has an aqueous moisturizer containing a polyol as a main component. As the moisturizer, glycerin can be typically mentioned, and as desired, 1,3-propanediol can be contained therein in an amount of 6.1% by mass or more and 12.6% by mass or less.

Noted that in addition to the moisturizer such as the glycerin, the tissue paper may also contain a known auxiliary agent. Examples of the auxiliary agent include an auxiliary moisturizing agent such as sorbitol, a hydrophilic polymeric gelling agent for enhancing the moisture-retaining properties of the tissue paper, a surfactant, a flexibility improver, an oily component such as liquid paraffin for assisting in the development of smoothness, and an emulsifier, a preservative, a defoamer, etc. for improving the stability and the coating properties of the moisturizer. Noted that components such as an auxiliary moisturizing agent and a hydrophilic polymeric gelling agent for enhancing the moisture-retaining properties are contained in such an amount as not to excessively affect the "fluffy and bulky texture," "softness" and "surface smoothness" of the tissue paper. Specifically, such a component may be contained in an amount of not more than 1.0 mass %, preferably not more than 0.6 mass %, more preferably not more than 0.5 mass %.

A 1-ply basis weight of the tissue paper of the present embodiment is preferably 15.0 to 18.5 g/m$^2$, in particular, more preferably 16.8 to 18.5 g/m$^2$. When the basis weight of each layer is within this range, the "softness", "fluffy and bulky texture" and "surface smoothness" become remarkable. In particular, when the basis weight is high, the paper tends to be hard, and when the basis weight is low, the paper tends to be soft. Therefore, it is considered that the basis weight greatly affects the "softness". Note that the basis weight is a value measured by the method based on JIS P 8124 (1998).

A chemical solution is applied to an outside surface of an outer layer, and the chemical solution permeates from the outside surface to the inside. Thus, the chemical solution works for improving the "softness" and "smoothness of the surface" due to a moisturizing effect of the chemical solution and a physical property of being smooth of the chemical solution. In addition, since the outer layer contains the chemical solution, an external pressure is applied on the outside surface of the outer layer in calendering or the like so that the paper is smoothed and the applied chemical solution becomes uniform to make the surface smooth. As a result, further increased "surface smoothness" is exhibited.

Noted that the paper thickness is a value measured based on a method in which a test piece is sufficiently conditioned under the condition of JIS P 8111 (1998) and the paper thickness is then measured under the same condition of JIS P 8111 (1998) using a dial thickness gauge (thickness meter) "PEACOCK G" (manufactured by OZAKI MFG. CO., LTD.) More particularly, after confirming that there are not dust etc. between the plunger and the measurement stand, the plunger is put down on the measurement stand and the scale of the dial thickness gauge is shifted for zero point adjustment. Subsequently, the plunger is put up and a test piece is put on the measurement stand. The plunger is slowly put down and at this time, a gauge is read. The terminal of the plunger is made of metal (and has a round flat surface with a diameter of 10 mm) and it should be noted that the terminal is vertically put on the flat surface of paper. Noted that a load is about 70 gf at the time of measuring paper thickness. Noted that the paper thickness is an average value obtained by repeating measurement ten times. As the test specimen, a 3-ply product sheet is adopted and measured at sites without folds and contact embossed portions.

Meanwhile, the tissue paper according to the present invention has a paper thickness for three plies of 176 to 230 μm. In a multi-ply structure such as 3-ply, the paper thickness tends to affect particularly the "softness" and "fluffy texture". In the tissue paper of the present embodiment, when the paper thickness is within this range, the "softness," "fluffy and bulky texture" and "surface smoothness" become remarkable.

On the other hand, the tissue paper of the present embodiment preferably has a dry strength of 300 to 420 cN/25 mm for three plies in the longitudinal direction. When the dry strength in the machine direction is within this range, the "softness," "fluffy and bulky texture" and "surface smoothness" become remarkable. In addition, the dry strength within such a range also secures the tissue paper to be sufficiently usable.

Further, the tissue paper preferably has a dry strength of 105 to 170 cN/25 mm for three plies in the lateral direction. When the dry strength in the lateral direction is within this range, the "softness," "fluffy and bulky texture" and "surface smoothness" become remarkable. In addition, the dry strength within such a range also secures the tissue paper to be sufficiently usable. Although it cannot be said certainly, the "dry tensile strength in the lateral direction" has an influence not on individual sensuality such as the "softness" or "fluffy texture" but on an overall sensuality for "texture." In a sensory evaluation, specific criteria for evaluations such as the "softness" and "fluffy texture" are not supplied to the evaluators, instead, the evaluators evaluate whether the tissue paper is good or not good on the basis of "texture" as an overall criterion for the evaluation after the evaluators have touched the sample freely. As a result, it is found that there is a certain relation between the evaluation of the "texture" and the "dry strength in the lateral direction."

In addition, it is desirable that the tissue paper of the present embodiment has a wet paper strength of 50 to 90 cN/25 mm for three plies in the lateral direction.

It is desirable that the ratio of the wet tensile strength in the lateral direction to the dry tensile strength in the lateral direction is 0.42 to 0.58. Noted that this ratio is based on the measurements for three plies as they are. Due to such a difference in the strength, the user feels "durability (strength, reliability)" in a usage mode of the tissue paper that changes from a dry state to a wet state in a case for example the user blows the nose. Furthermore, the change in the strength of the paper in such a usage mode becomes less likely to be felt, which affects the feeling of the user with respect to the "smoothness" of the tissue paper during the use thereof.

Noted that the longitudinal direction of paper is also called machine direction (MD), herein refers to the flow direction in a paper-making process for the paper. The lateral direction of paper is also called cross direction (CD), herein refers to a direction perpendicular to the flow direction (MD) in a paper-making process for the paper.

Furthermore, the dry tensile strength of the tissue paper of the present invention is measured according to JIS P 8113 as follows. A test specimen for the longitudinal direction and a test specimen for the lateral direction, each having a width of about 25 mm (±0.5 mm) and a length of about 150 mm, are prepared by cutting a tissue paper sheet. The tissue paper specimens, each consisting of a multi-ply sheet, are used as they are in the measurement. A load cell tensile testing machine TG-200N, manufactured by Minebea Co., Ltd., or a machine equivalent thereto, can be used as a testing machine. The chuck-to-chuck distance is set to 100 mm, and the tensile speed is set to 100 mm/min. The measurement is performed by the steps of: fastening both ends of a test specimen to the chucks of the testing machine; applying a vertical tensile load to the test specimen; and reading an indication value (digital value) upon breaking of the test specimen. 5 specimens are prepared for each of the longitudinal direction and the lateral direction. Thus, the measurement is performed 5 times for each direction, and the average of 5 measurement values for each direction is taken as a dry tensile strength value in the direction.

On the other hand, the wet tensile strength of the tissue paper of the present invention is measured pursuant to JIS P 8135 (1998) as follows. A test specimen for the longitudinal direction and a test specimen for the lateral direction, each having a width of about 25 mm (±0.5 mm) and a length of about 150 mm, are prepared by cutting a tissue paper sheet. The tissue paper specimens, each consisting of a multi-ply sheet, are used as they are in the measurement. A load cell tensile testing machine TG-200N, manufactured by Minebea Co., Ltd., or a machine equivalent thereto, is used as a testing machine. The chuck-to-chuck distance is set to 100 mm, and the tensile speed is set to 50 mm/min. The measurement is performed by the steps of: fastening both ends of a test specimen, which has been subjected to curing at 105° C. for 10 minutes in a dryer, to the chucks of the testing machine; then applying water horizontally to an about 10 mm-wide middle portion of the test specimen by using a flat brush saturated with water; then immediately applying a vertical tensile load to the test specimen; and reading an indication value (digital value) upon breaking of the test specimen. 5 specimens are prepared for each of the longitudinal direction and the lateral direction. Thus, the measurement is performed 5 times for each direction, and the average of 5 measurement values for each direction is taken as a wet tensile strength value in the direction.

In order to adjust the dry tensile strength and wet tensile strength, a dry paper strengthening agent and a wet paper strengthening agent can be internally added to paper materials or a wet paper web. As dry paper strengthening agents, starch, polyacrylamide, CMC (carboxymethylcellulose) or salts thereof such as sodium carboxymethylcellulose, calcium carboxymethylcellulose and zinc carboxymethylcellulose can be used. As wet paper strengthening agents, polyamide polyamine-epichlorohydrin resin, urea resin, acid colloid melamine resin, thermal crosslinking-coated PAM and the like can be used. Noted that when internally adding a dry paper strengthening agent, the amount added to pulp slurry is about 1.0 kg/pulp t or less. In addition, the wet paper strengthening agent is preferably a cationic agent, and it may be added to pulp slurry in an amount of about 5.0 to 20.0 kg/pulp t.

Fiber materials constituting the tissue paper are pulp fibers and are desirably NBKP (softwood (Nadelholz) bleached kraft pulp) and LBKP (hardwood (Laubholz) bleached kraft pulp) which are used for tissue paper. Used paper pulp can be blended, but since it is difficult for the used paper pulp to exhibit the "softness", it is extremely preferred that the tissue paper be constituted from only NBKP and LBKP, virgin pulp. The blending proportion is desirably NBKP:LBKP=25:75 to 40:60 by mass ratio. In this range, the "softness" and "smoothness" can be felt remarkably while the paper strength required for blowing the nose and the "fluffy and bulky texture" can be felt.

Manufacturing Method of Tissue Paper

The tissue paper according to the present embodiment and the product obtained by bundling, packaging and the like can be manufactured by the following manufacturing procedure. First, single layer tissue base paper with crepe after papermaking in papermaking equipment is wound up to be each primary paper roll. Then, three primary paper rolls are set to laminating equipment also called a ply machine. A continuous single layer sheet is drawn out from each primary paper roll. Then, three continuous single layer sheets are laminated to be a laminated sheet having three layers, and after that, for example the laminated sheet is suitably slit to wind a secondary paper roll. Next, using this secondary paper roll, a laminated bundle is formed in e.g. folding equipment also called inter folder. Consequently, the laminated bundle is for example cut into suitable sizes and after that, for example packaged in a box to manufacture tissue paper products. Applying equipment of the chemical solution is separately provided in any step or between steps in a series of production steps for manufacturing the product, in order to externally add the chemical solution of moisturizer (the moisturizing chemical solution) containing glycerin to the tissue base paper. The moisturizing chemical solution can be applied to one side of the tissue base paper. However, it is desirable to apply the moisturizing chemical solution to both sides of the tissue base paper such that smoothness can be uniform on the both sides of the tissue base paper easily. Particularly, the chemical solution is preferably applied to the tissue base paper in the form of a continuous sheet having a laminated structure of the tissue base paper. It is particularly desirable that the chemical solution is applied to the continuous sheet having the laminated structure of the tissue base paper, because the deterioration of strength as a whole of plies can be reduced, which is desirable in manufacturing operation and in addition, the moisturizing chemical solution can be ensured to be applied to the both outer layers to be contact with skin.

Specifically, the moisturizing chemical solution may be applied to the tissue base paper with a roll transfer device such as a flexographic press and a gravure printing machine and a chemical solution coating device such as a spray applicator, which are incorporated into either ply machine or interfolder, or which are installed as a separate facility therefrom.

The interfolder with which a folding process is performed may be a facility with which the folding process is performed by means of a folding plate. This facility is also called a multi-stand type, a stand type, or a folding plate type. Alternatively, the interfolder may be a facility with which the folding process is performed by means of pair of folding rolls also called a rotary type. However, the interfolder of this rotary type is preferable. In the case of a tissue paper product having a multi-ply structure of three plies or more, each layer is likely to shift due to the large number of layers. On the other hand, in the interfolder of the rotary type, since tension applied to the continuous sheet is lower than that in the interfolders of other types, each layer of the multi-ply structure is less likely to shift so that an excellent quality for folding can be easily attained. As a result, particularly in the folding process, the "fluffy texture" is not less likely to be reduced.

Further in particular, for manufacturing the tissue paper product according to the present embodiment, as an interfolder, it is preferable to use the interfolder of the rotary type. In addition, it is also preferable that calender processing is performed to the laminated sheet. Due to the calender processing performed to the laminated sheet, the difference in the paper thickness between the outer layer and the internal layer can be easily generated. Furthermore particularly, in the case where the folding process is performed with the interfolder of the rotary type, it is preferable that the moisturizing chemical solution is applied in the interfolder. In addition, when the first calender processing is performed before the moisturizing chemical solution is applied and the second calender processing is performed after the moisturizing chemical solution is applied, the tissue paper is easily obtained in which the "softness" and "smoothness" can be felt remarkably while the "fluffy and bulky texture" is felt.

A suitable example for manufacturing the tissue paper in accordance with the present invention is explained in the following. In FIG. 1, each of rolls 1, 2, 3 has wound 1-ply base paper after papermaking, and these three sheets of 1-ply base paper are drawn out from these rolls 1, 2, 3 and calendered through between two metal rolls 4, 5 in a state where these three sheets of 1-ply base paper are laminated to be 3-ply base paper, which is wound up to be a 3-ply base paper roll 6.

To 3-ply base paper from the 3-ply base paper roll 6, a moisturizing chemical solution is applied in a suitable manner.

Since the both outer surfaces of the 3-ply base paper are calendered through the metal rolls 4, 5, the surface smoothness is improved such that the arithmetic mean roughness Sa according to the present invention can be easily attained.

Figure 2:
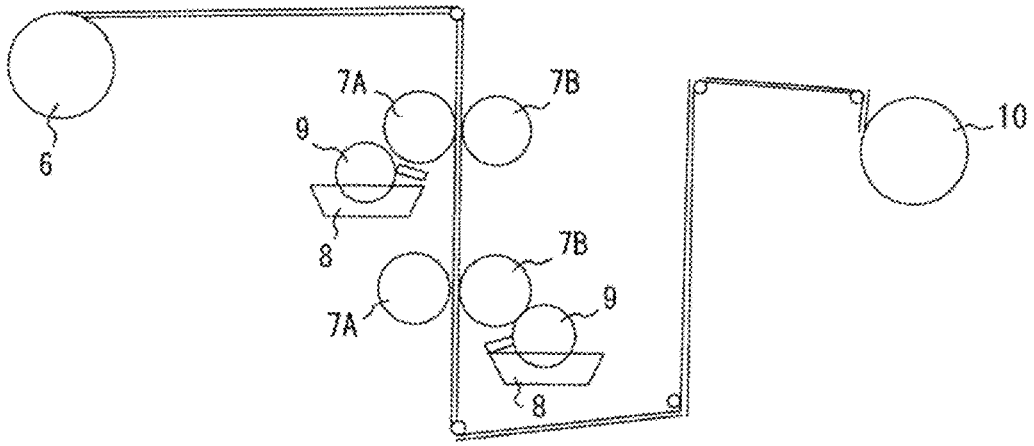
FIG. 2 is a schematic diagram illustrating an application mode of a chemical solution.
Figure 3:
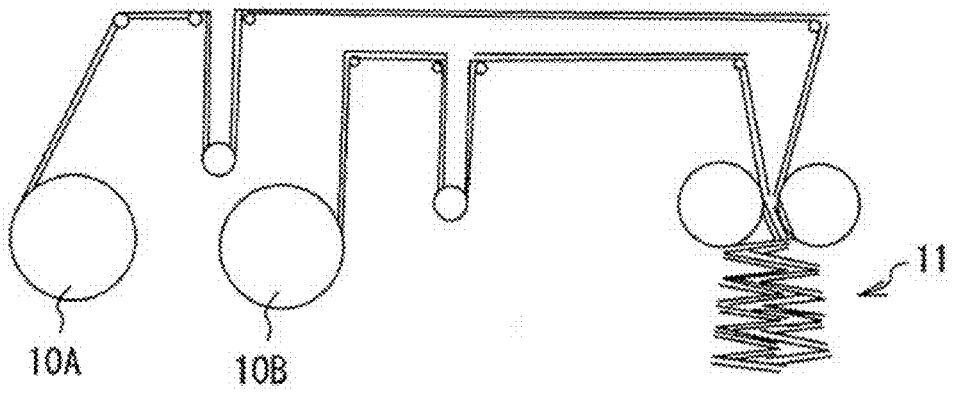
FIG. 3 is an explanatory drawing of a rotary interfolder.

As a manner in which the moisturizing chemical solution is applied, for example, the mode shown in FIG. 2 can be adopted.

That is, a 3-ply base paper sheet is drawn out from the 3-ply base paper roll 6, and a moisturizing chemical solution is picked up from a bat 8 with a gravure roll 9 so as to be transferred to a metal roll 7A. Then, the transferred chemical solution is applied to a first outer surface of the 3-ply base paper sheet passing between the metal roll 7A and another metal roll 7B opposing each other.

Next, at a subsequent position, a moisturizing chemical solution is applied to a second outer surface of the 3-ply base paper sheet in the same manner.

Finally, the 3-ply base paper sheet coated with the moisturizing chemical solutions is wound up to be a paper roll 10.

It has been confirmed that in order to smooth a surface, a gravure application method has a higher effect when compared with a case in which a moisturizing chemical solution is applied with the flexographic method.

A pair of moisturizing chemical solution-coated 3-ply base paper sheets from a paper roll 10A and a paper roll 10B, respectively, are folded with for example, a rotary interholder 11 so as to be a tissue paper product.

Since the moisturizing chemical solution is applied from the outside to the 3-ply base paper having a smooth surface with small unevenness, the internal layer contains the low concentration of moisturizing chemical solution, while each of both the outer layers contains the high concentration of moisturizing chemical solution. Furthermore, in each outer layer, an outside portion contains the high concentration of moisturizing chemical solution, while an inside portion contains the low concentration of moisturizing chemical solution. Thus, the specific volume of the internal layer is high and that of the inside portion of each outer layer is also high. As a result, the base paper becomes fluffy and soft tissue paper as a 3-ply product, and the surface of this product becomes smooth due to a plenty of the moisturizing chemical solution present in the surface.

For the ply base paper, an amount of applied moisturizing chemical solution is preferably 18.5 to 26.8%, in particular, more preferably 22.0 to 26.5%, based on the mass ratio.

On the other hand, it is preferable that crepes are formed on the base paper, and the amount of the applied chemical solution is preferably 22.0 to 26.5%.

It is preferable that 38 to 54 crepes are formed per one centimeter.

The number of crepes per one centimeter is measured with a one-shot 3D measurement as follows. A line segment is drawn along the machine direction on the base paper. Next, within the drawn line segment, the number of mountains of mountain and valley shapes each having the length of 1.0 to 2.0 cm along the machine direction are counted. Then, the counted number is divided by the length of the drawn line segment along the machine direction.

By performing a shape measurement with the one-shot 3D measurement, a height profile on the X-Y plane is defined on an image such that each height of the surface of the tissue base paper is shown in terms of contrasting density of color tones. Thus, a form of each crepe in the height direction can be confirmed from a measurement section curve profile. Here, for the crepes, valleys and mountains are formed in the perpendicular direction at an angle of 90 degrees to the machine direction. Accordingly, the number of crepes is obtained by counting the number of mountains of mountain and valley shapes each having the length of 1.0 to 2.0 cm along the machine direction, and by dividing the counted number by the measured length along the machine direction. The number of crepes in a sample shall be an average value of measurement values at 5 measuring sites.

The degree of pointed shape of peak of unevenness indicated by "arithmetic mean peak curvature Spc" is preferably 3.4 to 3.9 (1/mm) (each fine protrusion of the surface is pointed.)

It is preferable that a lipstick removal proportion in a lipstick wiping off test measured using a color fastness rubbing tester is 63.0 to 66.0%, which indicates a suitable a wiping property. That is, the tissue paper has a sufficient effect of wiping off the lipstick or foundation, but the tissue paper does not wipe off lipstick or foundation too much.

The tissue paper according to the embodiment described above and furthermore the effects thereof particularly will be described in "Examples."

EXAMPLES

Samples of the tissue paper according to the present invention and of tissue paper different from the tissue paper of the present invention were made and investigated by a sensory test described below about the evaluation items of the column of the sensory evaluation. In addition, the physical property values, composition values and the like of each sample were measured as follows. The physical property values and composition values of each sample and test results are as shown in Tables 1 and 2 below.

Basis Weight

The basis weight was measured in accordance with JIS P 8124 (1998).

Paper Thickness

The paper thickness was measured, under the conditions of JIS P 8111 (1998), in accordance with the above described measurement method of the thickness using the dial thickness gauge (thickness meter) "PEACOCK G" (manufactured by OZAKI MFG. CO., LTD.)

Dry Tensile Strength

The dry tensile strength was measured in accordance with the tensile test of JIS P 8113 (1998).

A test specimen for the longitudinal direction and a test specimen for the lateral direction, each having a width of about 25 mm (±0.5 mm) and a length of about 150 mm, were prepared by cutting a tissue paper sheet. The tissue paper specimens, each consisting of a multi-ply sheet, were used as they were in the measurement. A load cell tensile testing machine TG-200N, manufactured by Minebea Co., Ltd., was used as a testing machine. The chuck-to-chuck distance was set to 100 mm. The measurement was performed by the steps of: fastening both ends of a test specimen to the chucks of the testing machine; applying a vertical tensile load to the test specimen; and reading an indication value (digital value) upon breaking of the test specimen. The tensile speed was set to 100 mm/min. 5 specimens were prepared for each of the longitudinal direction and the lateral direction. Thus, the measurement was performed 5 times for each direction, and the average of 5 measurement values for each direction was taken as a dry tensile strength value in the direction. (As for the adjustment of test specimens, see JIS P 8111 (1998))

Wet Tensile Strength

The wet tensile strength was measured in accordance with the tensile test of JIS P 8135 (1998).

A test specimen for the longitudinal direction and a test specimen for the lateral direction, each having a width of about 25 mm (±0.5 mm) and a length of about 150 mm, were prepared by cutting a tissue paper sheet. The tissue paper specimens, each consisting of a multi-ply sheet, were used as they were in the measurement. A load cell tensile testing machine TG-200N, manufactured by Minebea Co., Ltd., was used as a testing machine. The chuck-to-chuck distance was set to 100 mm. The measurement was performed by the steps of: fastening both ends of a test specimen, which had been subjected to curing at 105° C. for 10 minutes in a dryer, to the chucks of the testing machine; then applying water horizontally to an about 10 mm-wide middle portion of the test specimen by using a flat brush saturated with water; then immediately applying a vertical tensile load to the test specimen; and reading an indication value (digital value) upon breaking of the test specimen. The tensile speed was set to 50 mm/min. 5 specimens were prepared for each of the longitudinal direction and the lateral direction. Thus, the measurement was performed 5 times for each direction, and the average of 5 measurement values for each direction was taken as a wet tensile strength value in the direction.

Softness

The softness was measured by the Handle-O-Meter method according to JIS L 1096 method E, using a test specimen having a size of 100 mm×100 mm. The clearance was set to 5 mm. For the 1-ply test sample the measurement was performed 5 times for each of the longitudinal direction and the lateral direction, and the average of a total of 10 measurement values was taken as a softness value expressed in cN/100 mm. The value of "Softness" is one of indexes showing the soft degree of the tissue paper.

Compressional Properties

The compressional properties (for four sets of three plies, twelve sheets in total) were measured by "KES-G5" manufactured by KATO TECH CO., LTD.

The compressional properties were measured using the compression tester (Handy Compression Tester KES-G5 manufactured by Kato Tech Co., Ltd.). 3-ply base tissue paper sheet was cut into a 3-ply sheet having the size of 7 cm×7 cm, and four sets of the 3-ply sheet were stacked into a test specimen. This test specimen was set on a test stand of the compression tester. The test specimen was placed on the test stand so that an axis for a compression sensor hit perpendicularly the center of the test specimen. In the tester KES-G5, the compression sensor (having an area of 2.0 $cm^2$) was pushed into the test specimen under a condition in which the maximum load was set to 300 gf (150 $gf/cm^2$) and the displacement rate was set to 0.02 mm/sec. Then, the compression work ($gf \cdot cm/cm^2$), compression recovery rate (%), and difference between Tm and T0 (TM−T0, mm) were obtained, wherein an indentation depth was T0 when the compression sensor pushed the test specimen under a pressure of 0.5 $gf/cm^2$, and an indentation depth was Tm when the compression sensor pushed the test specimen under a pressure of 150 $gf/cm^2$. The measurement was performed for 10 test specimens, and the average of 10 measurement results was adopted as the measurement value.

For obtaining a paper thickness (three plies) under the pressure of 70 $gf/cm^2$, a measurement was performed as follows. A relationship between an indentation depth (mm) and the pressure ($gf/cm^2$) on the indentation was shown graphically. Thus, an indentation depth $T^{70}$ (mm) under the pressure of 70 $gf/cm^2$ was obtained, while an indentation depth $T^{B}$ under a pressure of 70 $gf/cm^2$ was obtained in a state where a test specimen did not exist. A difference between these two values ($|T^{70}-T^{B}|$) was divided by 4(plies) so as to obtain a paper thickness (three plies) under a pressure of 70 $gf/cm^2$. The resultant value was substantially same as a value obtained by a measurement for a single set with PEACOCK G paper thickness meter (the terminal of the plunger having the diameter of 10 mm, load of 70 gf).

The compressive modulus of elasticity ($gf/cm^2$, four sets, load of 70 $gf/cm^2$) was obtained by using the function of Excel as follows. "Scatter Chart" is selected from "Insert" in Excel menu, "Quadratic function" is selected from "Addition of Trendline" in "Scatter Chart", and using selected "Quadratic function", the indentation depth and the pressure were graphically shown over a range of pressure of 40 $gf/cm^2$ to 100 $gf/cm^2$. Then, the slope ($gf/cm^2/cm$) in this graph under a load of 70 $gf/cm^2$ was obtained. So, the compressive modulus of elasticity ($gf/cm^2$) was given by multiplying the obtained slope by the paper thickness (cm) of 4 sets of 3-ply tissue base paper under the load of 70 $gf/cm^2$.

Sensory Test

Using Comparative Example 5 as a reference sample, the evaluation thereof was determined to be "4.0". The number of the evaluators is twelve and the average of the scores of the evaluators was taken as an evaluation value.

The tissue paper sheets of Comparative Example 5 to Comparative Example 9 were tissue paper products commercially available in China. The tissue paper sheet of Comparative Example 4 was a 2-ply moisturizing tissue paper product sold by the applicant. The tissue paper sheet of Comparative Examples 1 to 3 were those in a development process by the applicant.

With respect to the removing and "wiping off ability" of lipstick and foundation, Japanese products were used which were sold by two companies respectively.

The measurement in the lipstick wiping off test was performed with a color fastness rubbing tester in the following procedures.

(1) An EVA sponge sheet (DAISO CO., LTD. EVA sponge sheet "HRM-18P-15") having the thickness of 1.5 mm was cut into a piece having width of 20 mm and length of 75 mm. Then, a test specimen (a tissue paper sheet) having a width of 20 mm and a length of 70 mm was attached to the center portion in the longitudinal direction of the piece of EVA sponge sheet with tapes provided at the both end portions of the test specimen in the longitudinal direction thereof.

(2) The EVA sponge sheet and the test specimen were set on the surface of the rubbing finger of Color Fastness Rubbing Tester(TESTER SANGYO CO., LTD. "AB-301") to be screwed thereto.

(3) A polystyrene sheet (DAISO CO., LTD. Shrinking plastic craft sheet "SAT-17-P20 D154") having a thickness of 0.254 mm, width of 28 mm and length of 250 mm was prepared. Then, a piece of man-made leather "CLARINO" (Kuraray Co., Ltd.) having the surface area of 10 $cm^2$ (width of 2 cm×length of 5 cm) was attached to the center of the prepared polystyrene sheet.

(4) 7 to 12 mg of lipstick or foundation was applied uniformly to the 10 $cm^2$ of the man-made leather and spread there uniformly over the man-made leather with a horsehair brush.

(5) The total weight (A) of lipstick applied to the surface of the man-made leather, the man-made leather and the polystyrene sheet was measured by ten thousandth of a gram and they were set on the tester.

(6) A test specimen stand was set at the innermost position of the tester. At this time, the rubbing finger was required not to touch the portion of man-made leather to which the lipstick or the foundation was applied.

(7) The rubbing finger was set at the front side of the tester, then the switch of the tester was turned on, and when the rubbing finger reached the innermost position, the tester was terminated by turning off the switch.

(8) The rubbing finger was pulled up and it was confirmed that the lipstick or the foundation was attached uniformly in the width direction to the rubbing finger at the tissue portion thereof.

(9) The total weight (B) of the man-made leather from which the lipstick had been removed by the test specimen and polystyrene sheet was measured by ten thousandth of a gram.

(10) The remained lipstick was further removed carefully and completely from the man-mead leather with other tissue paper to which nothing is applied and the total weight (C) of the man-made leather from which the lipstick had been removed completely and polystyrene sheet was measured by ten thousandth of a gram. During the measurements of the weights, it was confirmed that there was no changing of temperature and humidity and there was no vibration and it was also confirmed that the respective measured weights by ten thousandth of a gram were constant for 30 seconds. After that, the indicated weights were used as measurement values.

(11) The lipstick removal proportion was obtained by the following equation. That is, {(A)−(B);(The weight of lipstick applied to "CLARINO")−(The weight of remained lipstick on "CLARINO" after removing the lipstick by the sample)}/(A)−(C);(The weight of lipstick applied to "CLARINO")×100(%).

The foundation removal proportion was obtained in the same way.

TABLE 1

| | | | Comparative Example 1 | Comparative Example 2 | Example 1 | Example 2 | Example 3 | Example 4 | Example 5 | Comparative Example 3 |
|---|---|---|---|---|---|---|---|---|---|---|
| | Number of ply | ply | 3 | 3 | 3 | 3 | 3 | 3 | 3 | 3 |
| | Basis weight 1 P | $g/m^2$ | 14.4 | 14.7 | 17.0 | 16.3 | 17.9 | 17.4 | 18.0 | 16.3 |
| | Paper thickness 3 P PEACOCK G 70 $gf/cm^2$ | μm | 168 | 175 | 194 | 198 | 202 | 207 | 218 | 222 |
| | Dry paper strength (longitudinal) 3 P | cN/25 mm | 312 | 351 | 381 | 399 | 355 | 370 | 384 | 321 |
| | Dry paper strength (lateral) 3 P | cN/25 mm | 90 | 111 | 136 | 152 | 125 | 112 | 156 | 99 |
| | Wet paper strength (lateral) 3 P | cN/25 mm | 62 | 78 | 74 | 84 | 69 | 62 | 83 | 40 |
| | Softness 1 P | cN/100 mm | 0.7 | 0.7 | 0.7 | 0.8 | 0.7 | 0.7 | 0.7 | 0.6 |
| | MMD 3 P Surface corresponding to mountain side of fold | 1/100 | 7.4 | 6.8 | 6.9 | 7.3 | 7.2 | 7.0 | 7.5 | 6.2 |
| | Moisture content | % | 10.8 | 14.3 | 16.6 | 17.0 | 17.2 | 17.5 | 18.6 | 15.6 |
| | Amount of applied chemical solution | % | 17.8 | 18.3 | 23.1 | 24.1 | 24.3 | 25.1 | 25.8 | 28.6 |
| Surface state of product unprocessed state | Arithmetic mean roughness (Sa) | mm | 0.018 | 0.020 | 0.012 | 0.015 | 0.016 | 0.011 | 0.015 | 0.029 |
| | Arithmetic mean peak curvature (Spc) | 1/mm | 2.664 | 2.888 | 3.455 | 3.622 | 3.784 | 3.788 | 3.851 | 4.111 |
| | Number of crepes/cm MD | number/cm | 41.0 | 41.3 | 42.1 | 42.2 | 42.3 | 42.6 | 42.9 | 45.0 |
| Compressional Properties KES-G5 | Compression work | gf · cm/$cm^2$ | 1.45 | 1.56 | 1.81 | 1.86 | 1.95 | 1.96 | 2.15 | 1.68 |
| | Compression recovery rate | % | 56.6 | 58.4 | 48.6 | 50.2 | 49.9 | 52.3 | 53.6 | 56.7 |
| | Paper thickness 3 P under pressure of 70 $gf/cm^2$ | μm | 168 | 175 | 195 | 192 | 202 | 196 | 211 | 223 |
| | (TM-T0) conversion to single set under load of 0.5 to 150 $gf/cm^2$ | mm | 0.156 | 0.210 | 0.265 | 0.271 | 0.288 | 0.306 | 0.321 | 0.365 |

TABLE 1-continued

| | | | Comparative Example 1 | Comparative Example 2 | Example 1 | Example 2 | Example 3 | Example 4 | Example 5 | Comparative Example 3 |
|---|---|---|---|---|---|---|---|---|---|---|
| | Compressive modulus of elasticity four sets under load of 70 gf/cm$^2$ | gf/cm$^2$ | 661 | 558 | 554 | 563 | 587 | 572 | 590 | 455 |
| Wiping off test | Removal proportion of lipstick made by company S | % | 54.6% | 55.1% | 64.8% | 65.1% | 64.4% | 65.3% | 66.0% | 46.6% |
| | Removal proportion of lipstick made by company K | % | 51.4% | 52.3% | 61.6% | 61.8% | 61.2% | 62.0% | 62.7% | 48.6% |
| | Removal proportion of foundation made by company S | % | 56.7% | 55.9% | 66.6% | 68.2% | 66.0% | 67.1% | 68.0% | 51.2% |
| | Removal proportion of foundation made by company K | % | 53.3% | 53.5% | 63.5% | 65.1% | 63.4% | 63.5% | 63.5% | 53.0% |
| Sensory test evaluation on seven-point scale | Toughness (firmness) | 1 to 7 | 3.3 | 3.4 | 5.4 | 5.7 | 5.3 | 5.4 | 5.6 | 4.0 |
| | Moist feeling (moisture-retaining property) | 1 to 7 | 4.0 | 4.0 | 5.0 | 5.1 | 5.1 | 5.3 | 5.0 | 4.3 |
| | Wiping property | 1 to 7 | 3.6 | 3.8 | 5.4 | 5.5 | 5.4 | 5.3 | 5.3 | 4.0 |
| | Softness | 1 to 7 | 5.4 | 5.2 | 5.1 | 5.3 | 5.1 | 5.0 | 5.3 | 3.8 |
| | Smoothness | 1 to 7 | 5.3 | 4.8 | 5.5 | 5.6 | 5.2 | 5.5 | 5.1 | 3.9 |

TABLE 2

| | | | Comparative Example 4 | Comparative Example 5 | Comparative Example 6 | Comparative Example 8 | Comparative Example 9 |
|---|---|---|---|---|---|---|---|
| | Number of ply | ply | 2 | 3 | 3 | 3 | 3 |
| | Basis weight 1 P | g/m$^2$ | 17.1 | 16.1 | 15.7 | 18.1 | 14.6 |
| | Paper thickness 3 P PEACOCK G 70 gf/cm$^2$ | μm | 147 | 195 | 199 | 148 | 273 |
| | Dry paper strength (longitudinal) 3 P | cN/25 mm | 199 | 213 | 440 | 869 | 725 |
| | Dry paper strength (lateral) 3 P | cN/25 mm | 69 | 110 | 143 | 128 | 470 |
| | Wet paper strength (lateral) 3 P | cN/25 mm | 45 | 38 | 58 | 75 | 149 |
| | Softness 1 P | cN/100 mm | 1.0 | 0.8 | 0.7 | 1.1 | 1.2 |
| | MMD 3 P Surface corresponding to mountain side of fold | 1/100 | 7.1 | 6.9 | 7.6 | 6.6 | 8.5 |
| | Moisture content | % | 12.3 | 13.0 | 9.4 | 16.1 | 6.8 |
| | Amount of applied chemical solution | % | 25.5 | 19.0 | 19.0 | 27.4 | 0.0 |
| Surface state of product unprocessed state | Arithmetic mean roughness (Sa) | mm | 0.032 | 0.031 | 0.019 | 0.023 | 0.022 |
| | Arithmetic mean peak curvature (Spc) | 1/mm | 3.791 | 4.162 | 4.498 | 1.989 | 6.900 |
| | Number of crepes/cm MD | number/cm | 47.4 | 39.7 | 41.6 | 48.8 | 47.5 |
| Compressional Properties KES-G5 | Compression work | gf · cm/cm$^2$ | 1.53 | 1.71 | 1.42 | 1.36 | 2.13 |
| | Compression recovery rate | % | 63.5 | 55.4 | 56.2 | 57.5 | 65.4 |
| | Paper thickness 3 P under pressure of 70 gf/cm$^2$ | μm | 150 | 195 | 199 | 148 | 270 |
| | (TM-T0) conversion to single set under load of 0.5 to 150 gf/cm$^2$ | mm | 0.191 | 0.165 | 0.106 | 0.249 | 0.548 |
| | Compressive modulus of elasticity four sets under load of 70 gf/cm$^2$ | gf/cm$^2$ | 877 | 548 | 661 | 558 | 688 |

TABLE 2-continued

| | | | Comparative Example 4 | Comparative Example 5 | Comparative Example 6 | Comparative Example 8 | Comparative Example 9 |
|---|---|---|---|---|---|---|---|
| Wiping off test | Removal proportion of lipstick made by company S | % | 71.6% | 74.9% | 76.7% | 47.8% | 75.5% |
| | Removal proportion of lipstick made by company K | % | 65.1% | 59.5% | 65.8% | 57.8% | 87.7% |
| | Removal proportion of foundation made by company S | % | 68.5% | 67.9% | 68.4% | 65.6% | 71.0% |
| | Removal proportion of foundation made by company K | % | 71.4% | 66.7% | 63.1% | 62.1% | 71.8% |
| Sensory test evaluation on seven-point scale | Toughness (firmness) | 1 to 7 | 3.1 | 4.0 | 3.4 | 3.3 | 5.4 |
| | Moist feeling (moisture-retaining property) | 1 to 7 | 4.3 | 4.0 | 3.1 | 5.0 | 1.6 |
| | Wiping property | 1 to 7 | 2.8 | 4.0 | 2.3 | 4.6 | 3.4 |
| | Softness | 1 to 7 | 4.1 | 4.0 | 5.1 | 5.2 | 2.3 |
| | Smoothness | 1 to 7 | 4.5 | 4.0 | 4.8 | 3.6 | 2.2 |

According to the above results, it is known that 3-ply tissue paper can be obtained which is suitable for performing "tissue off" and excellent in softness and smoothness.

The invention claimed is:

1. A tissue paper comprising:

3-ply tissue paper consisting of an internal layer and two outer layers arranged on each side of the internal layer; and an aqueous moisturizer contained in the 3-ply tissue paper, wherein a ply of the internal layer contains a lower concentration of a moisturizing chemical solution of the aqueous moisturizer, and a ply of each outer layer contains a higher concentration of the moisturizing chemical solution of the aqueous moisturizer, wherein the tissue paper has a paper thickness of 176 to 230 μm in three plies, an arithmetic mean roughness Sa of 0.007 to 0.020 mm, a compression work of 1.70 to 2.40 gfcm/cm$^2$ and a compression recovery rate of 46.0 to 54.5% for four sets of three plies, twelve plies in total.

2. The tissue paper according to claim 1, wherein a basis weight per one ply is 16.8 to 18.5 g/m$^2$.

3. The tissue paper according to claim 1, wherein an amount of the chemical solution applied is 22.0 to 26.5%.

4. A method for manufacturing the tissue paper according to claim 1, comprising:

calendering a 3-ply base paper through between two metal rolls in a state where three sheets of 1-ply base paper are stacked; and applying a chemical solution to the 3-ply base paper.

5. A method for manufacturing the tissue paper according to claim 1 comprising picking up a chemical solution with a gravure roll;

transferring the picked-up chemical solution to a metal roll; and applying the transferred chemical solution to a surface of 3-ply base paper formed of three stacked sheets of 1-ply base paper while passing through between the metal roll and another metal roll opposing each other.

6. A method for manufacturing the tissue paper according to claim 1 comprising:

picking up a chemical solution with a gravure roll;

transferring the picked-up chemical solution to a metal roll;

applying the transferred chemical solution to a first outer surface of 3-ply base paper formed of three stacked sheets of 1-ply base paper while passing through between the metal roll and another metal roll opposing each other;

at a subsequent position, picking up a chemical solution with a gravure roll;

transferring the picked-up chemical solution to a metal roll; and applying the transferred chemical solution to a second outer surface of the 3-ply base paper while passing through between the metal roll and another metal roll opposing each other.

* * * * *